US007848895B2

(12) United States Patent
Zoback et al.

(10) Patent No.: US 7,848,895 B2
(45) Date of Patent: Dec. 7, 2010

(54) PREDICTING CHANGES IN HYDROFRAC ORIENTATION IN DEPLETING OIL AND GAS RESERVOIRS

(75) Inventors: Mark D. Zoback, Stanford, CA (US); Amy D. F. Day-Lewis, Ashford, CT (US); Sangmin Kim, Marina, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 225 days.

(21) Appl. No.: 12/009,143

(22) Filed: Jan. 15, 2008

(65) Prior Publication Data

US 2008/0249721 A1 Oct. 9, 2008

Related U.S. Application Data

(60) Provisional application No. 60/880,790, filed on Jan. 16, 2007.

(51) Int. Cl.
*G01L 1/00* (2006.01)
*E21B 43/26* (2006.01)
*E21B 47/00* (2006.01)

(52) U.S. Cl. ..... 702/42; 166/250.1

(58) Field of Classification Search ..... 702/42, 702/11, 151; 166/250.1
See application file for complete search history.

(56) References Cited

U.S. PATENT DOCUMENTS

| | | | | |
|---|---|---|---|---|
| 3,878,884 | A * | 4/1975 | Raleigh | 165/45 |
| 4,005,750 | A * | 2/1977 | Shuck | 166/308.1 |
| 4,044,828 | A * | 8/1977 | Jones et al. | 73/783 |
| 4,446,433 | A * | 5/1984 | Shuck | 324/338 |
| 4,635,719 | A | 1/1987 | Zoback et al. | |
| 4,724,905 | A * | 2/1988 | Uhri | 166/250.1 |
| 4,744,245 | A * | 5/1988 | White | 73/152.58 |
| 4,850,431 | A * | 7/1989 | Austin et al. | 166/308.1 |
| 4,977,961 | A * | 12/1990 | Avasthi | 166/297 |
| 5,318,123 | A | 6/1994 | Venditto et al. | |
| 5,335,724 | A | 8/1994 | Venditto et al. | |
| 5,360,066 | A | 11/1994 | Venditto et al. | |
| 5,386,875 | A * | 2/1995 | Venditto et al. | 166/308.1 |
| 5,482,116 | A * | 1/1996 | El-Rabaa et al. | 166/250.1 |
| 6,834,233 | B2 * | 12/2004 | Economides et al. | 702/1 |
| 6,985,816 | B2 | 1/2006 | Sorrells et al. | |
| 7,111,681 | B2 | 9/2006 | Detournay et al. | |
| 7,165,616 | B2 | 1/2007 | Jorgensen | |
| 7,181,380 | B2 * | 2/2007 | Dusterhoft et al. | 703/10 |
| 2003/0150263 | A1 * | 8/2003 | Economides et al. | 73/152.48 |
| 2005/0234648 | A1 * | 10/2005 | Economides et al. | 702/6 |
| 2006/0283589 | A1 * | 12/2006 | Sayers | 166/254.1 |

* cited by examiner

*Primary Examiner*—Cindy H Khuu
(74) *Attorney, Agent, or Firm*—Lumen Patent Firm

(57) ABSTRACT

Stress rotation due to depletion can be estimated in reservoirs having an impermeable reservoir boundary. More specifically, the isotropic change in stress due to depletion, and the uniaxial stress resulting from a change in pore pressure across an impermeable boundary are both modeled as perturbations to an initial stress state. These perturbations can result in a rotation of the principal stress directions. Estimates of the stress rotation are helpful for hydraulic fracturing operations, because fracture tends to occur in a plane perpendicular to the least principal stress.

8 Claims, 4 Drawing Sheets

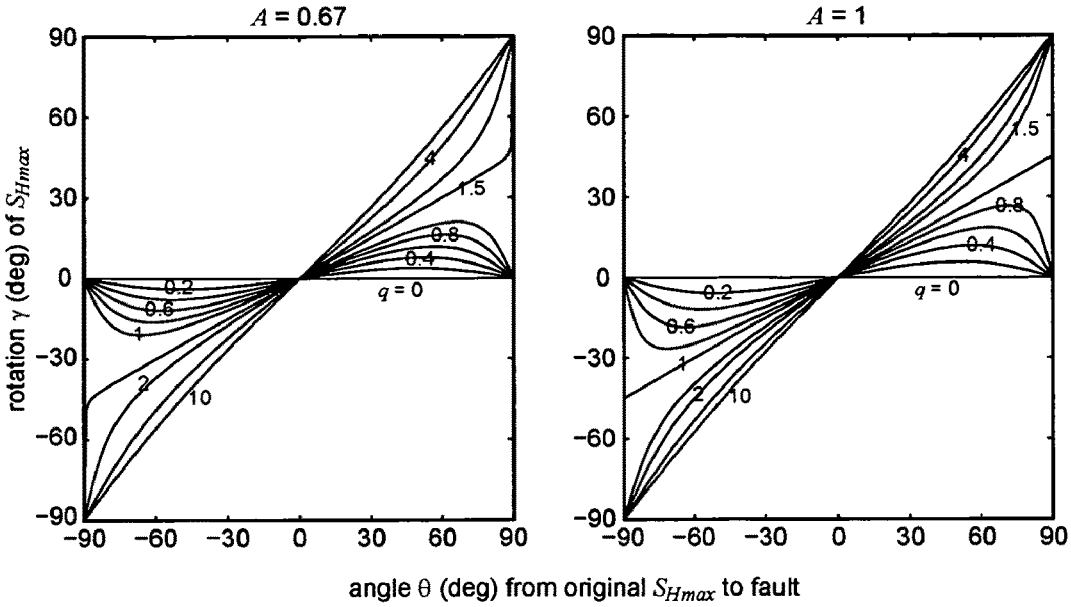
Fig. 3a
Fig. 3b
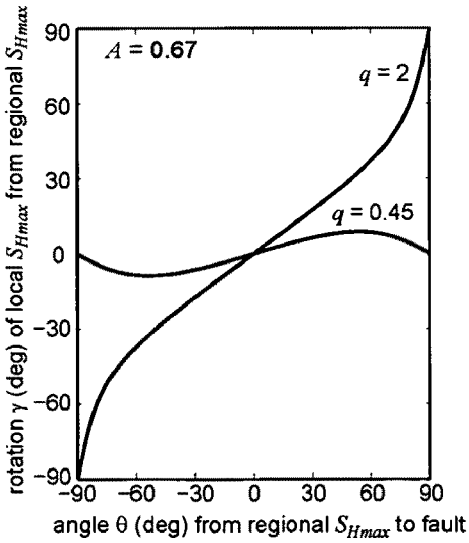
Fig. 4

PREDICTING CHANGES IN HYDROFRAC ORIENTATION IN DEPLETING OIL AND GAS RESERVOIRS

CROSS REFERENCE TO RELATED APPLICATIONS

This application claims the benefit of U.S. provisional patent application 60/880,790, filed on Jan. 16, 2007, entitled "Predicting Changes in Hydrofrac Orientation in Depleting Oil and Gas Reservoirs", and hereby incorporated by reference in its entirety.

FIELD OF THE INVENTION

This invention relates to prediction of hydraulic fracture direction in oil and/or gas reservoirs.

BACKGROUND

Hydraulic fracturing is a technique for improving production from hydrocarbon reservoirs (e.g., oil and/or gas reservoirs). Hydraulic fracturing entails injecting a liquid into a reservoir so as to create new fractures in the reservoir. In cases where hydrocarbons can move more freely along such fractures than within solid reservoir rock, hydraulic fracture can significantly improve reservoir production.

Accordingly, methods of measuring, predicting and/or controlling hydraulic fracture are of great interest, and have been investigated for some time. For example, in U.S. Pat. No. 7,111,681, detailed mathematical modeling of fracture propagation is considered. In U.S. Pat. No. 4,744,245, in-situ measurements of stress orientation are performed to assist in predicting fracture direction. In U.S. Pat. No. 6,985,816, measurements of microseismic events are employed to determine orientation of fractures resulting from hydraulic fracturing treatment.

In U.S. Pat. No. 7,165,616, separate fracture wells and production wells are operated in a coordinated manner to provide control of hydraulic fracture direction. In U.S. Pat. No. 5,386,875, perforations are formed along a plane of expected fracture formation to provide improved control of fracture direction. In U.S. Pat. No. 5,355,724, a slot is formed in a rock formation undergoing hydraulic fracture to improve control of hydraulic fracture. In U.S. Pat. No. 5,482,116, a deviated wellbore in a direction parallel to a desired fracture direction is employed to provide improved control of hydraulic fracture direction.

However, it remains difficult to understand and/or predict hydraulic fracture direction in cases where reservoir depletion affects reservoir stresses.

Accordingly, it would be an advance in the art to provide a simple method of predicting hydraulic fracture direction in depleted reservoirs.

SUMMARY

According to embodiments of the invention, stress rotation due to depletion can be estimated in reservoirs having an impermeable reservoir boundary. More specifically, the isotropic change in stress due to depletion, and the uniaxial stress resulting from a change in pore pressure across an impermeable boundary are both modeled as perturbations to an initial stress state. These perturbations can result in a rotation of the principal stress directions. Estimates of the stress rotation are helpful for hydraulic fracturing operations, because fracture tends to occur in a plane perpendicular to the least principal stress.

The methodology described in this application is to predict the change in hydraulic fracture orientation after some degree of depletion (pore pressure reduction due to production) has occurred. The importance of this is that it defines cases in which repeating a hydraulic fracturing operation in an existing well will provide an opportunity for the fracture to go in a new direction and access hydrocarbons in an as yet undepleted part of a reservoir. The current state of the art is such that when wells are re-hydraulically fractured after depletion, there is typically no way of knowing whether the new hydraulic fracture will go in a new direction or not.

Evaluating the potential for re-fracturing from existing wells in this manner allows for significant cost reductions and improved recovery from already-produced hydrocarbon reservoirs.

BRIEF DESCRIPTION OF THE DRAWINGS

FIGS. 3*a-b* show calculated stress rotation for various examples.

FIG. 4 shows calculated stress rotation for a first case study relating to an embodiment of the invention.

DETAILED DESCRIPTION

Figure 1:
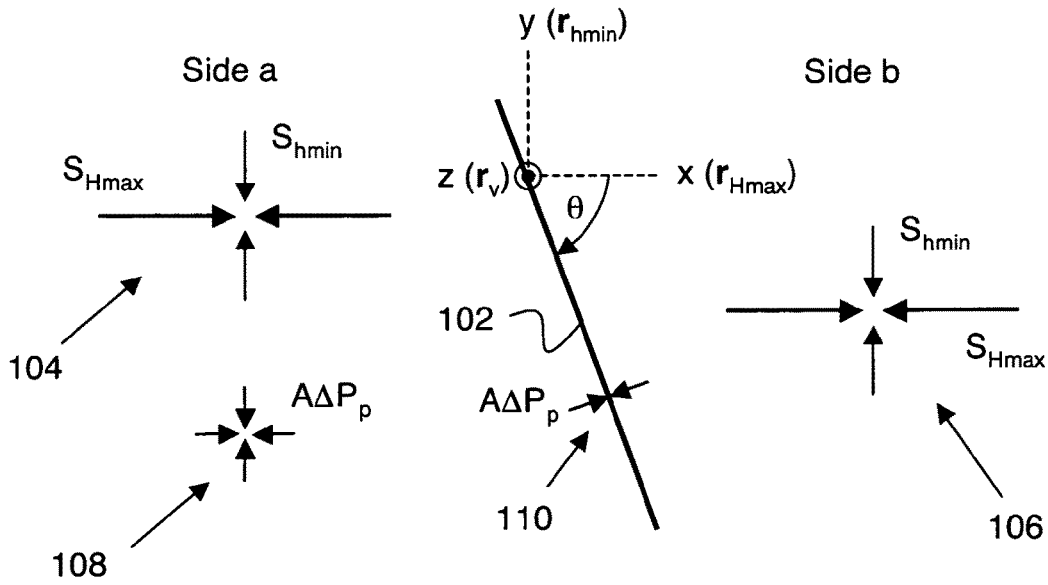
FIG. 1 shows model geometry suitable for understanding embodiments of the invention.

Key aspects of the invention can most readily be understood by reference to the model geometry of FIG. 1, which is a schematic top view of a horizontal reservoir boundary 102 separating Side a from Side b. Boundary 102 is assumed to be impermeable, and it is also assumed that the vertical direction (i.e., perpendicular to both x and y on FIG. 1) is a principal stress direction, referred to as $r_v$. The horizontal principal stresses on Sides a and b respectively are schematically shown by 104 and 106 respectively, where $S_{Hmax}$ and $S_{hmin}$ are the larger and smaller horizontal principal stresses, respectively. As is well known in the art, the three principal stress directions are mutually orthogonal.

Side a is assumed to be a reservoir that has undergone depletion, so stresses 104 are regarded as an initial stress state, and the main purpose of the following model is to estimate the changes to this initial stress state due to depletion. It is assumed that the local effect of a change in pore pressure $\Delta P_p$ is to induce a horizontally isotropic stress change $\Delta S_H = A\ \Delta P_p$, schematically shown as 108 on FIG. 1, where the proportionality constant A is often referred to as the stress path. The stress path can be determined empirically from repeated measurements of stress magnitudes as a reservoir undergoes depletion and/or injection, or it can be estimated from physical properties of the reservoir. For example, in a laterally extensive, homogeneous, isotropic reservoir having elastic properties that do not differ greatly from the surrounding rock, the vertical stress does not change with pore pressure, and $A=\alpha(1-2\nu)/(1-\nu)$, where $\alpha$ is the Biot coefficient and $\nu$ is Poisson's ratio. Common values of A range from 0.5 to 1 (e.g., if $\alpha=1$ and $\nu=0.25$, then $A=2/3$).

In addition to the isotropic stress change 108, a change in pore pressure also results in a uniaxial stress 110 at boundary 102, because the pore pressure change occurs only on Side a of boundary 102. This uniaxial stress perturbation is in a direction normal to the boundary and has magnitude $A\,\Delta P_p$. Since the normal stress must be continuous across the boundary, both sides of the boundary experience the same change in normal stress.

In the following development, stress perturbations 108 and 110 are added to initial stress 104 on Side a to determine a perturbed stress state for Side a. Similarly, perturbation 110 is added to stress 106 on Side b to determine a perturbed stress state for Side b. Here it is convenient to choose a coordinate system having the x-axis aligned with the unperturbed $S_{Hmax}$. More specifically, the x axis is aligned with the principal stress direction $r_{Hmax}$ corresponding to $S_{Hmax}$, and the y axis is aligned with the principal stress direction $r_{hmin}$ corresponding to $S_{hmin}$. In these coordinates, the components of uniaxial perturbation 110 are given by $$\psi_x = \frac{A\Delta P_p}{2}(1-\cos 2\theta) \qquad (1)$$
$$\psi_y = \frac{A\Delta P_p}{2}(1+\cos 2\theta)$$
$$\psi_{xy} = -\frac{A\Delta P_p}{2}\sin 2\theta$$

where $\theta$ is the angle between the x axis and boundary 102, as shown on FIG. 1.

On Side a, the perturbed stress components are given by $$S_x^a = S_{Hmax} + A\Delta P_p + \frac{A\Delta P_p}{2}(1-\cos 2\theta) \qquad (2)$$
$$S_y^a = S_{hmin} + A\Delta P_p + \frac{A\Delta P_p}{2}(1+\cos 2\theta)$$
$$S_{xy}^a = -\frac{A\Delta P_p}{2}\sin 2\theta$$

and on Side b, the perturbed stress components are given by $$S_x^b = S_{Hmax} + \frac{A\Delta P_p}{2}(1-\cos 2\theta) \qquad (3)$$
$$S_y^b = S_{hmin} + \frac{A\Delta P_p}{2}(1+\cos 2\theta)$$
$$S_{xy}^b = -\frac{A\Delta P_p}{2}\sin 2\theta$$

In Eqs. 2 and 3, the shear stress $S_{xy}$ is typically non-zero, which is an indication that x and y are not principal stress directions of the perturbed stress state. The new principal stress directions are rotated relative to the x-y coordinates by an angle $\gamma$ which is given by $$\gamma = \frac{1}{2}\tan^{-1}\left[\frac{2S_{xy}}{S_x - S_y}\right]. \qquad (4)$$

This rotation is the same on both sides of boundary 102, because $S_{xy}$ and the difference $S_x$-$S_y$ are the same on both sides of the boundary. Therefore, $$\gamma = \frac{1}{2}\tan^{-1}\left[\frac{-A\Delta P_p \sin 2\theta}{(S_{Hmax} - S_{hmin}) - A\Delta P_p \cos 2\theta}\right]. \qquad (5)$$

It is helpful to define a parameter q via $$q = \frac{-\Delta P_p}{S_{Hmax} - S_{hmin}}, \qquad (6)$$

so q is the negative ratio of pore pressure change to horizontal differential stress. By substituting Eq. 6 into Eq. 5, the following simpler result can be obtained:

$$\gamma = \frac{1}{2}\tan^{-1}\left[\frac{Aq\sin 2\theta}{1 + Aq\cos 2\theta}\right]. \qquad (7)$$

In this convention, $\theta$ is positive for depletion (negative $\Delta P_p$), and $\gamma$, like $\theta$, is clockwise positive.

Figure 2:
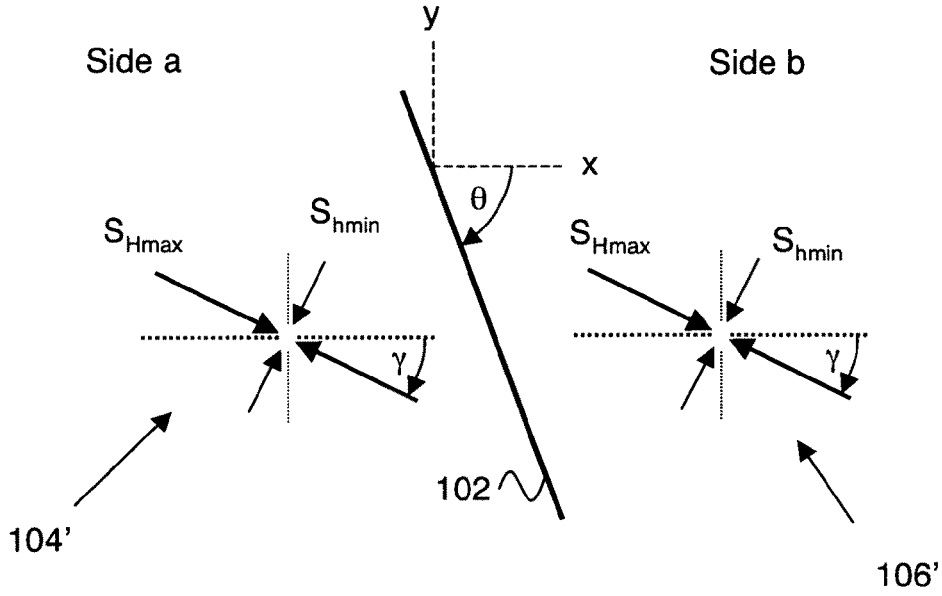
FIG. 2 shows rotation of principal stress directions as predicted according to embodiments of the invention.

The effect of this perturbation on principal stress directions is shown on FIG. 2, where 104' schematically shows the perturbed principal stress directions on Side a, and 106' schematically shows the perturbed principal stress directions on Side b.

FIGS. 3*a-b* illustrate the amount of stress rotation expected for values of q between 0 and 10 (depletion) near boundaries having any azimuth and for two difference stress paths. In all cases, the sign of $\gamma$ is the same as the sign of $\theta$, meaning $S_{Hmax}$ will rotate to be more parallel to the boundary. For small q, the predicted stress rotations are generally small. However, for $q \geqq 1$, the amount of stress reorientation can be quite large, particularly for large values of A.

The validity of this model has been investigated by way of two case studies. The first case study relates to the Arcabuz field in northeast Mexico. The differential horizontal stress magnitude is approximately 0.2 psi/ft, and pore pressure is 0.9 psi/ft at most. Depletion estimates range from 0.09 to 0.4 psi/ft. Using these values, estimates of q range from 0.45 to 2. FIG. 4 illustrates the result of applying the above model to these q values, assuming A=0.67. For q=0.45, the maximum expected stress rotation is about 10°, which is too low to account for the stress rotation range of −75° to 85° observed in the Arcabuz field. For q=2, however, estimated stress rotations span the observed range.

Figure 5A:
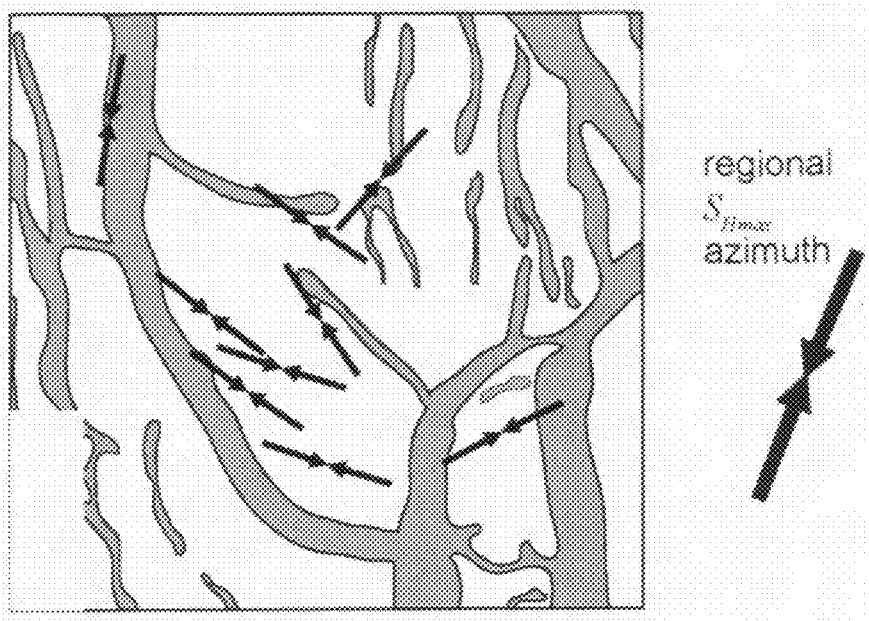
FIGS. 5*a-b* show a comparison between actual fault orientation in a depleted reservoir and fault orientation as estimated according to an embodiment of the invention, for a first case study.
Figure 5B:
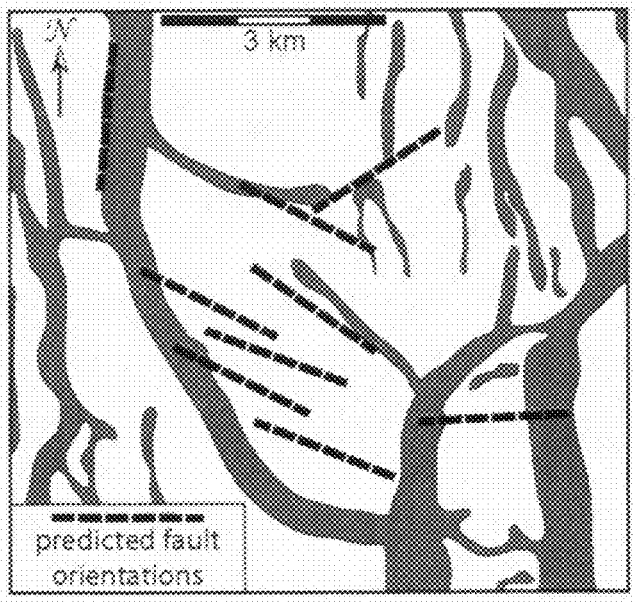

A more substantial consistency check can be obtained by comparing known local stress orientations with the orientation of nearby faults (which can act as impermeable boundaries), and seeing if these stress orientations are consistent with the model, assuming q=2 and A=⅔. FIG. 5*a* shows known local stress orientations at various wells in the Arcabuz Field (as pairs of opposing arrows), and the regional $S_{Hmax}$ azimuth is shown to the right of FIG. 5*a*. Mapped faults in this field are shown in gray. Significant and highly variable stress rotation relative to the regional $S_{Hmax}$ azimuth is clearly apparent. FIG. 5*b* shows the predicted boundary orientations at each well that would provide the observed rotation of $S_{Hmax}$ relative to the regional $S_{Hmax}$ azimuth. In most cases, a fault exists nearby having the predicted orientation, even if it is not the closest or largest mapped fault.

Figure 6A:
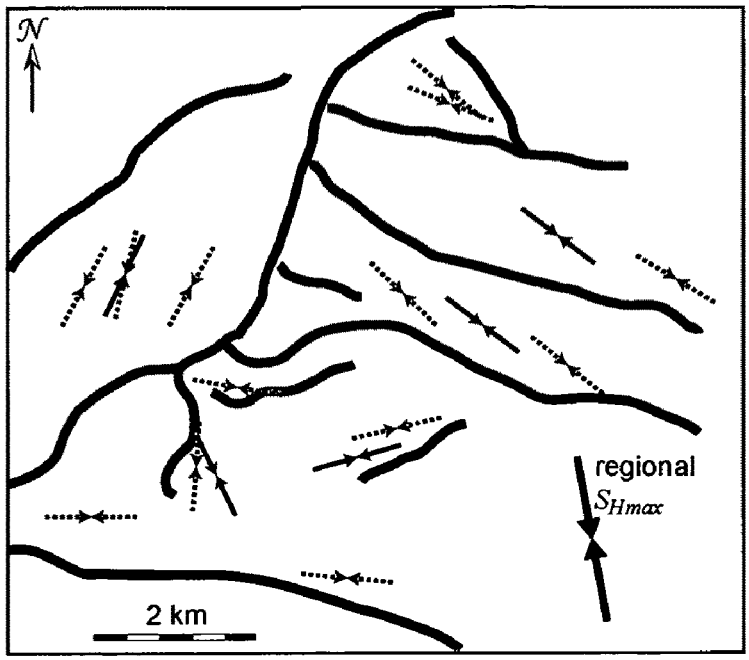
FIGS. 6*a-b* show a comparison between actual fault orientation in a depleted reservoir and fault orientation as estimated according to an embodiment of the invention, for a second case study.
Figure 6B:
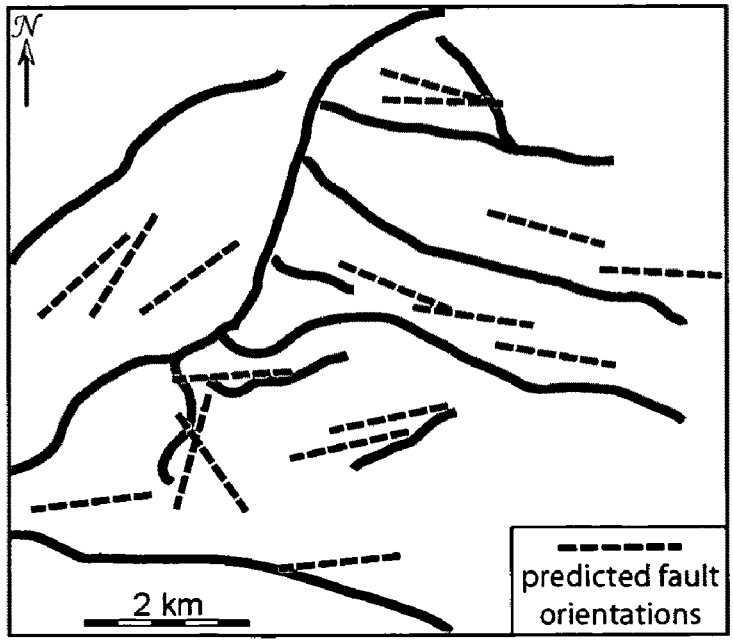

FIGS. 6*a-b* show results from a second case study, relating to the Scott Field in the United Kingdom section of the North Sea. Observed stress orientations in this field are shown on FIG. 6*a*, where the solid arrows pertain to data from acoustic anisotropy of core samples, and the dotted arrows relate to data from wellbore breakouts. Mapped faults in this field are shown as gray lines. The Scott Field is heavily depleted, with production reducing the pore pressure from ~65 MPa to ~5 MPa. Estimating the differential horizontal stress to be less than or equal to 33 MPa, the q value for the field is greater than or equal to 2. FIG. 6*b* shows the results of applying the model to the Scott field data, assuming q=2 and A=2/3. The dashed lines show predicted fault orientations that would account for the observed stress rotation. As in the preceding example, most of the predicted fault orientations closely match nearby mapped faults.

The preceding model is based on several simplifying assumptions. These include: 1) the boundary is assumed to be impermeable; 2) the reservoir experiences no horizontal strain; 3) the elastic properties of the reservoir formation are the same on both sides of the boundary; and 4) the change in pore pressure is isothermal.

Impermeable reservoir boundaries are commonly encountered in practice. For example, inactive faults are frequently impermeable. Stream channel boundaries can also provide impermeable boundaries, as can abrupt changes in formation lithology (e.g., a sharp transition from sandstone to shale). As the term is used herein, "boundaries" can refer to interfaces between compartments of a reservoir, or to boundaries between a reservoir formation and surrounding non-reservoir rock. Although production can cause previously inactive faults in a reservoir to become active (e.g., displaying shear, gas leakage, subsidence and/or microseismicity), neither of the above-described case study fields show signs of being seismically active.

Assumption #2 above applies when the lateral extent of the reservoir is greater than about 5-10 times its thickness, which is commonly the case. However, a single reservoir compartment may not satisfy this condition. In practice, this possibility tends not to be a significant issue, because reservoir thickness tends to mainly affect the vertical stress, which is irrelevant to the present model. The effect of elastic property contrasts on pressure induced stress changes has been investigated by other workers, with the result that assumption #3 above is valid if Young's modulus on one side of the boundary is within 0.2 to 1.5 times Young's modulus on the other side of the boundary, which is often the case in practice.

In practice, the above-described model can be employed to predict changes in reservoir stress orientation due to changes in reservoir pore pressure. More specifically, a method according to an embodiment of the invention includes the steps of providing an estimate of an initial stress state (e.g., $S_{Hmax}$, $S_{hmin}$, and $\theta$) and pore pressure of a reservoir; providing an estimate of a change in pore pressure $\Delta P_p$; computing a stress rotation angle $\gamma$ depending on $\Delta P_p$, $S_{Hmax}-S_{hmin}$, and $\theta$; and providing a perturbed reservoir stress orientation (e.g., the angle $\gamma$) as an output.

Suitable methods for obtaining estimates of initial stress state and pore pressure, and for obtaining estimates of pore pressure change $\Delta P_p$ are well known in the art, and any such approach can be employed in practicing the invention. For example, $\Delta P_p$ can be estimated based on measured pore pressure data and/or known production history of a reservoir.

In a preferred embodiment, the previous method is extended to hydraulic fracture applications. More specifically, a fracture plane perpendicular to a least principal stress of the perturbed reservoir stress orientation can be determined. Because hydraulic fracture will tend to occur in this fracture plane, such information can be employed in design and planning of hydraulic fracture operations. This approach allows for the effect of reservoir depletion on the direction of likely hydraulic fracture to be accounted for using a simple model. For example, hydraulic fracture can be initiated at a point selected such that a fracture (including the initiation point and within the estimated fracture plane) has the potential to reach regions of the reservoir which are relatively undepleted.

The invention claimed is:

1. A method of hydraulic fracturing comprising:

providing an estimate of an initial stress orientation and an initial pore pressure of a reservoir having an impermeable boundary, wherein said initial stress orientation comprises two initial principal stress values $S_{Hmax}$ and $S_{hmin}$ corresponding to two orthogonal initial horizontal principal stress directions $r_{Hmax}$ and $r_{hmin}$, respectively;

providing an estimate $\Delta P_p$ of a change in reservoir pore pressure relative to said initial pore pressure;

computing a stress rotation angle $\gamma$ relating a perturbed stress orientation to said initial stress orientation;

wherein said stress rotation angle $\gamma$ depends on $\Delta P_p$, a difference of two initial principal stress values given by $S_{Hmax}-S_{hmin}$, and an angle $\theta$ of said impermeable boundary relative to said orthogonal initial horizontal principal stress directions $r_{Hmax}$ and $r_{hmin}$;

determining a fracture plane perpendicular to a least principal stress of said perturbed stress orientation based on said stress rotation angle $\gamma$; and performing hydraulic fracture in said reservoir based on an assumption that hydraulic fracture will tend to occur in said fracture plane.

2. The method of claim 1, wherein a third orthogonal initial principal stress direction $r_v$ is in a plane of said impermeable boundary.

3. The method of claim 2, wherein said angle $\theta$ is an angle between an azimuth of said impermeable boundary and $r_{Hmax}$ in a plane defined by $r_{Hmax}$ and $r_{hmin}$.

4. The method of claim 3, wherein a uniaxial stress perturbation relating to said impermeable boundary is given by $A\Delta P_p$, wherein A is a reservoir stress path relating changes in pore pressure to corresponding changes in horizontal stress.

5. The method of claim 4, wherein said angle $\gamma$ is given by $$\gamma = \frac{1}{2}\tan^{-1}\left[\frac{-A\Delta P_p \sin 2\theta}{(S_{Hmax} - S_{hmin}) - A\Delta P_p \cos 2\theta}\right].$$

6. The method of claim 1, further comprising initiating said hydraulic fracture at an initiation point selected such that said hydraulic fracture has the potential to reach regions of said reservoir which are relatively undepleted.

7. The method of claim 1, wherein said estimate $\Delta P_p$ is based on data including production history of said reservoir and/or measured pore pressure data.

8. The method of claim 1, wherein said impermeable boundary results from a geological structure selected from the group consisting of stream channel boundaries, reservoir-bounding faults, and abrupt changes in formation lithology.

* * * * *